US012031797B2

(12) United States Patent
Teetzel et al.

(10) Patent No.: US 12,031,797 B2
(45) Date of Patent: Jul. 9, 2024

(54) PRESSURE PAD ACCESSORY CONTROLLER FOR WEAPON

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 17/834,208

(22) Filed: Jun. 7, 2022

(65) Prior Publication Data

US 2022/0412696 A1 Dec. 29, 2022

Related U.S. Application Data

(60) Provisional application No. 63/214,753, filed on Jun. 24, 2021.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 5,355,608 A 10/1994 Teetzel
5,448,847 A 9/1995 Teetzel
5,481,819 A * 1/1996 Teetzel ..... F41A 19/58 42/117
5,522,167 A 6/1996 Teetzel
5,555,662 A 9/1996 Teetzel
5,570,528 A 11/1996 Teetzel
5,669,174 A 9/1997 Teetzel
5,685,105 A * 11/1997 Teetzel ..... F41A 21/30 42/146
5,787,628 A 8/1998 Teetzel
5,822,905 A * 10/1998 Teetzel ..... F41G 1/36 42/117
5,831,718 A * 11/1998 Desai ..... G01C 3/08 89/41.06
6,230,431 B1 * 5/2001 Bear ..... F41G 11/001 42/117
6,378,237 B1 * 4/2002 Matthews ..... H01H 3/20 42/146

(Continued)

FOREIGN PATENT DOCUMENTS

EP 4109035 A1 12/2022
WO 2016033119 A1 3/2016

OTHER PUBLICATIONS

Extended European Search Report received in European patent application No. 22178578.5, dated Nov. 11, 2022.

*Primary Examiner* — Michelle Clement
(74) *Attorney, Agent, or Firm* — McLane Middleton, Professional Association

(57) ABSTRACT

A pressure pad accessory controller for a weapon includes a rail interface, a pressure pad portion, a keypad having one or more user-depressible control elements disposed on the pressure pad portion, and one or more electrical connectors for operably coupling the keypad to one or more accessory devices.

18 Claims, 9 Drawing Sheets

(56) References Cited

U.S. PATENT DOCUMENTS 6,568,118 B1 * 5/2003 Teetzel ..... F41G 1/48 42/105
7,199,315 B1 * 4/2007 Sharrah ..... F41G 1/34 200/61.43
7,273,292 B2 * 9/2007 Kim ..... F41G 1/34 42/117
7,332,682 B2 * 2/2008 Kim ..... F41G 11/003 200/18
7,438,430 B2 * 10/2008 Kim ..... F41G 11/003 200/18
7,441,918 B2 * 10/2008 Kim ..... F41G 1/34 200/18
7,676,975 B2 * 3/2010 Phillips ..... F41C 23/16 42/72
7,845,105 B1 * 12/2010 Cahill ..... F41C 27/00 42/117
8,091,265 B1 * 1/2012 Teetzel ..... F41C 23/16 42/71.01
8,151,511 B2 * 4/2012 Gentilini ..... F41G 1/16 42/111
8,220,946 B1 7/2012 Teetzel
8,297,173 B1 10/2012 Teetzel et al.
8,458,944 B2 * 6/2013 Houde-Walter ..... F41C 23/16 42/72
8,776,422 B2 * 7/2014 Dodd ..... F41G 11/003 42/72
9,228,804 B2 * 1/2016 Syrengelas ..... F41G 1/345
9,546,848 B1 * 1/2017 Burger, Sr. ..... F41G 11/003
9,644,915 B2 * 5/2017 Alderman ..... F41A 19/59
9,658,031 B1 * 5/2017 Hedeen ..... F41C 33/0263
9,897,411 B2 * 2/2018 Compton ..... F41G 11/00
9,966,204 B2 * 5/2018 McCauley ..... F41G 11/003
9,991,062 B2 * 6/2018 Zimmer ..... H01H 9/0235
10,060,705 B2 * 8/2018 Compton ..... H04B 5/0031
10,082,363 B2 * 9/2018 Burgess ..... F41G 11/003
10,514,235 B1 * 12/2019 McCauley ..... H01H 9/02
10,641,583 B2 * 5/2020 Zimmer ..... F41G 11/003
10,782,101 B2 * 9/2020 Sabaldan Elpedes .... F41G 1/30
11,009,315 B1 * 5/2021 Huang ..... F21S 9/02
11,060,820 B2 * 7/2021 Zimmer ..... F41G 11/003
11,067,363 B2 * 7/2021 Galli ..... F41G 11/003
11,092,323 B2 * 8/2021 Hawk ..... F21V 23/0414
D931,233 S * 9/2021 Pan ..... D22/108
11,118,859 B1 * 9/2021 Hawk ..... F21V 23/0485
D947,310 S * 3/2022 Zimmer ..... D22/108
11,310,398 B2 * 4/2022 Green ..... H04N 23/51
11,514,775 B2 * 11/2022 Zimmer ..... H01R 33/955
2005/0116815 A1 * 6/2005 Chen ..... F41G 1/35 340/331
2007/0235298 A1 * 10/2007 Kim ..... F41G 1/34 200/18
2008/0134562 A1 6/2008 Teetzel
2011/0261559 A1 * 10/2011 Couture ..... F21L 4/005 362/208
2012/0085013 A1 * 4/2012 Cahill ..... F41C 27/00 42/96
2012/0266514 A1 * 10/2012 Michal ..... F41G 1/34 42/90
2013/0086722 A1 4/2013 Teetzel et al.
2015/0153130 A1 * 6/2015 Amis ..... A63F 13/837 434/21
2015/0215749 A1 7/2015 Teetzel et al.
2015/0247703 A1 9/2015 Teetzel et al.
2015/0264229 A1 9/2015 Teetzel et al.
2016/0010949 A1 1/2016 Teetzel et al.
2016/0069640 A1 * 3/2016 Pretorius ..... F41G 3/065 42/122
2016/0102943 A1 4/2016 Teetzel et al.
2016/0327371 A1 11/2016 Teetzel et al.
2017/0082399 A1 * 3/2017 Moore ..... F41G 1/36
2017/0205194 A1 7/2017 Teetzel et al.
2017/0205202 A1 7/2017 Teetzel et al.
2018/0053607 A1 * 2/2018 McCauley ..... F41G 11/003
2019/0208854 A1 7/2019 Teetzel et al.
2019/0249958 A1 8/2019 Teetzel et al.
2019/0376755 A1 12/2019 Teetzel et al.
2021/0315314 A1 10/2021 Teetzel et al.
2021/0356234 A1 * 11/2021 Bigby ..... F41G 11/001
2022/0120533 A1 4/2022 Teetzel et al.
2022/0221944 A1 * 7/2022 Patel ..... F41G 11/003
2023/0003486 A1 * 1/2023 Johnson, Sr. ..... F41G 11/003

* cited by examiner

PRESSURE PAD ACCESSORY CONTROLLER FOR WEAPON

CROSS REFERENCE TO RELATED APPLICATION

This application contains the priority benefit of U.S. provisional application Ser. No. 63/214,753 filed Jun. 24, 2021. The aforementioned application is incorporated herein by reference in its entirety.

BACKGROUND

The present invention relates to a pressure pad weapon accessory controller. The apparatus disclosed herein includes one or more connector cables for controlling one or more weapon-mounted accessory devices and a dual cable configuration for controlling a weapon-mounted accessory device such as aiming and/or illumination laser devices, weapon-mounted flashlights, and the like.

SUMMARY

In one aspect, an apparatus for controlling operation of a weapon-mounted accessory device comprises a pressure pad interface rail comprising a rail attachment portion configured to couple with a first transverse edge of a weapon accessory rail. The pressure pad interface rail further comprises an elongate channel. A pressure pad housing has an elongate mounting member disposed on a first surface thereof and one or more user-depressible control elements disposed on a second surface thereof, the elongate mounting member configured to slidably engage the elongate channel. A first drawbar has a proximal end configured to detachably engage the rail attachment portion of the pressure pad interface rail and a distal end forming a hook, the hook configured to engage a second transverse edge of the weapon accessory rail opposite the first transverse edge. A first electrical connector is in electrical communication with the one or more user-depressible control elements and is configured to operably couple the user-depressible control elements to the weapon-mounted accessory device.

In a more limited aspect, the elongate channel has a trapezoidal cross sectional shape.

In another more limited aspect, the one or more user-depressible control elements comprises a keypad having a plurality of user-depressible switches.

In yet another more limited aspect, each of the user-depressible switches has a three-dimensional shape which is different than the other ones of the user-depressible switches.

In another more limited aspect, the weapon accessory rail is a Picatinny rail interface comprising a plurality of transverse mounting projections extending perpendicular along a longitudinal axis of the weapon accessory rail and separated by a plurality of transverse grooves spaced along the longitudinal axis of the weapon accessory rail.

In yet another more limited aspect, the drawbar is at least partially received within one of the transverse grooves.

In yet another more limited aspect, the first drawbar has a width which is approximately equal to a width of the transverse grooves.

In another more limited aspect, the first drawbar includes a threaded fastener passing through a first clearance hole in the rail attachment portion and threadably engaging a threaded opening in the proximal end of the first drawbar wherein tightening the threaded fastener exerts a clamping force on the weapon accessory rail between the rail attachment portion and the hook and further wherein loosening the threaded fastener releases the clamping force on the weapon accessory rail between the rail attachment portion and the hook.

In yet another more limited aspect, a second clearance opening engages a second drawbar, wherein the second clearance opening is axially spaced apart from the first clearance opening.

In yet another more limited aspect, each of the first and second drawbars is at least partially received within an aligned one of the transverse grooves.

In another more limited aspect, a second drawbar has a proximal end configured to detachably engage the rail attachment portion of the pressure pad interface rail and a distal end forming a hook, the hook configured to engage a second transverse edge of the weapon accessory rail opposite the first transverse edge, wherein the second drawbar is axially spaced apart from the first drawbar.

In another more limited aspect, the first transverse edge of the weapon accessory rail has a first beveled surface engaging a complementary beveled surface on the pressure pad interface rail and the second transverse edge of the weapon accessory rail has a second beveled surface engaging a complementary beveled surface on the hook.

In another more limited aspect, a first detention feature is disposed on the elongate mounting member and a second detention feature complementary with the first detention feature is disposed within the elongate channel. The first and second detention features cooperate to secure the pressure pad housing in a fixed position on the pressure pad interface rail when the first and second detention features are aligned and engaging and to allow sliding movement of the pressure pad housing with respect to the pressure pad interface rail when the first and second detention features are not aligned and engaging.

In yet another more limited aspect, the first and second detention features are symmetrically positioned to secure the pressure pad housing in a fixed position on the pressure pad interface rail when the pressure pad housing is disposed in a first orientation with respect to the pressure pad interface rail and in a second orientation with respect to the pressure pad interface rail, the second orientation being one hundred eighty degrees from the first orientation.

In yet another more limited aspect, a third detention feature is disposed on the elongate mounting member and a fourth detention feature complementary with the third detention feature is disposed within the elongate channel, the third and fourth detention features cooperating to secure the pressure pad housing in a fixed position on the pressure pad interface rail when the third and fourth detention features are aligned and engaging and to allow sliding movement of the pressure pad housing with respect to the pressure pad interface rail when the first and second detention features are not aligned and engaging.

In another more limited aspect, a first cable electrically couples the first electrical connector with the one or more user-depressible control elements. The first cable extends from the housing in a direction parallel to a longitudinal axis of the weapon accessory rail.

In yet another more limited aspect, a second cable electrically couples a second electrical connector with the one or more user-depressible control elements. The second cable extends from the housing in a direction parallel to the longitudinal axis of the weapon accessory rail.

In yet another more limited aspect, each of the first and second electrical connectors is configured to electrically couple the one or more user-depressible control elements to an accessory device selected from the group consisting of laser accessory devices and flashlights.

In another more limited aspect, the weapon accessory rail includes four elongate mounting rails angularly spaced about a barrel of an associated weapon, wherein the pressure pad housing is positioned intermediate adjacent ones of the four elongate mounting rails.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT(S)

The terms "a" or "an," as used herein, are defined as one or more than one. The term "another," as used herein, is defined as at least a second or more. The terms "including" and/or "having" as used herein, are defined as "comprising" (i.e., open transition). Unless specifically stated otherwise, the terms "attached," "coupled," "operatively coupled," "joined", and the like are defined as indirectly or directly connected.

As used in this application, the terms "front," "rear," "upper," "lower," "upwardly," "downwardly," and other orientation descriptors are intended to facilitate the description of the exemplary embodiment(s) of the present invention, and are not intended to limit the structure thereof to any particular position or orientation.

Figure 1:
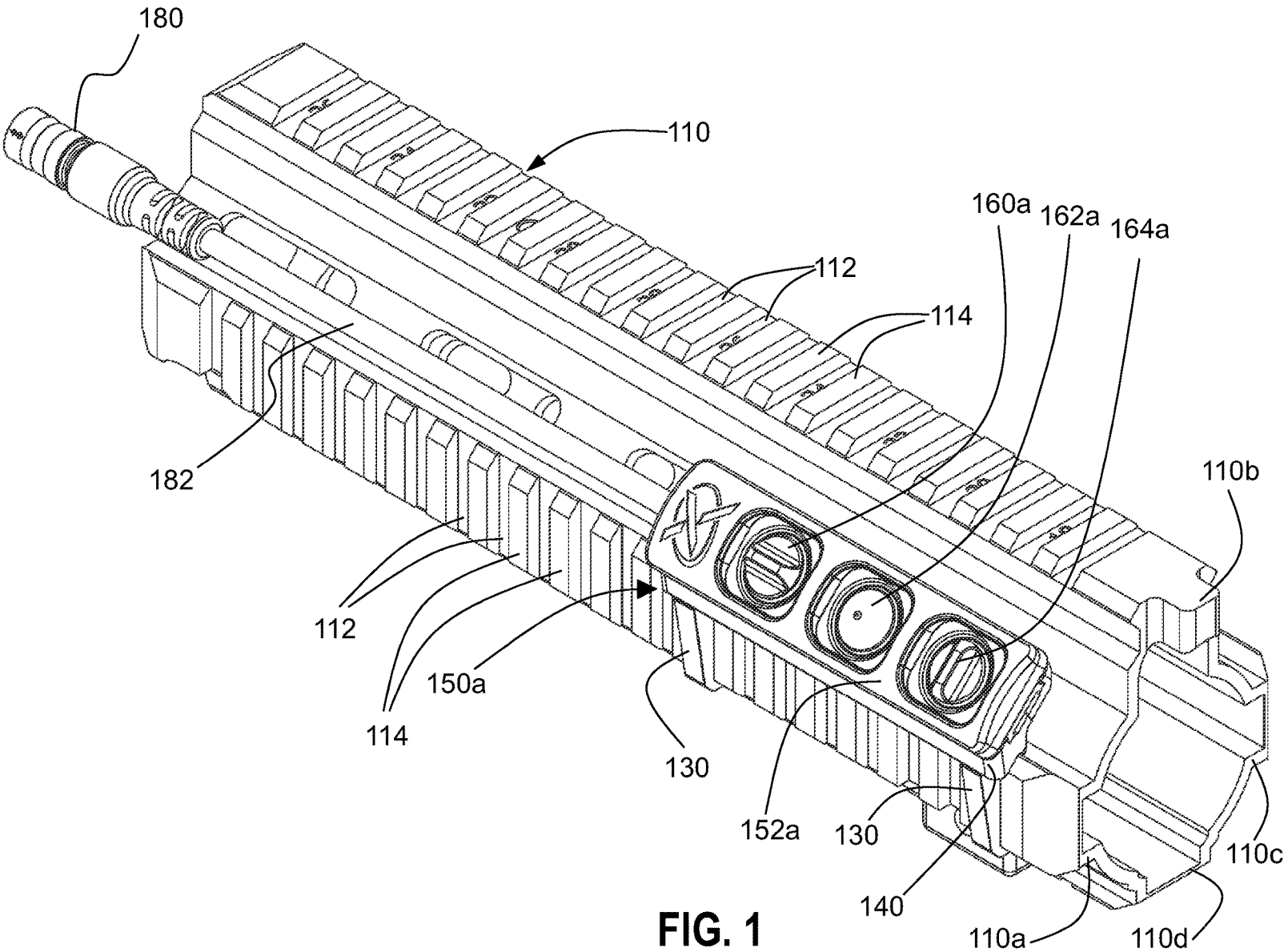
FIG. 1 is an isometric view of a first exemplary embodiment of a pressure pad control apparatus herein having a single cable configuration, shown attached to a weapon accessory rail.
Figure 2:
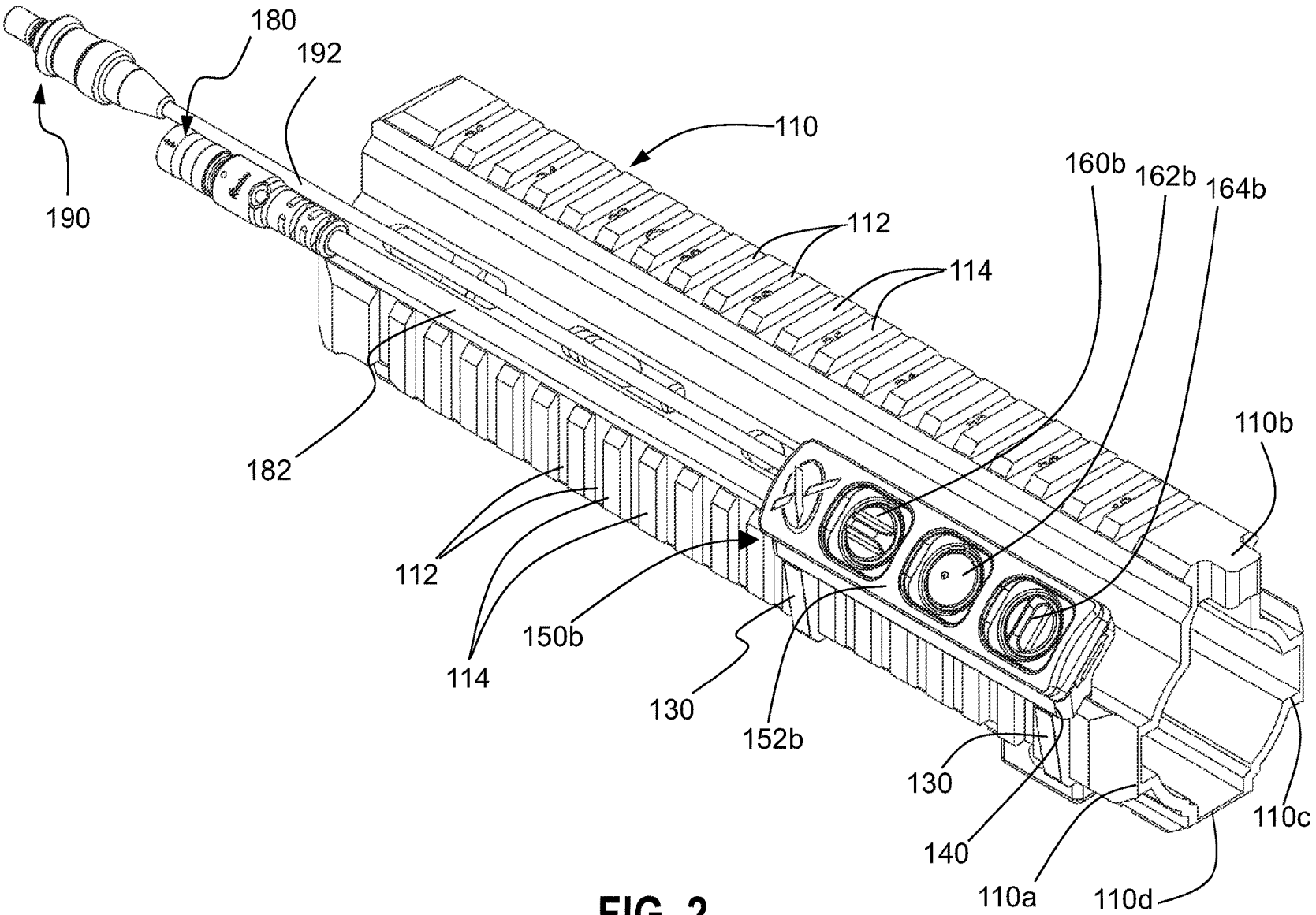
FIG. 2 is an isometric view of a second exemplary embodiment of a pressure pad control apparatus herein having a dual cable configuration, shown attached to a weapon accessory rail.
Figure 3:
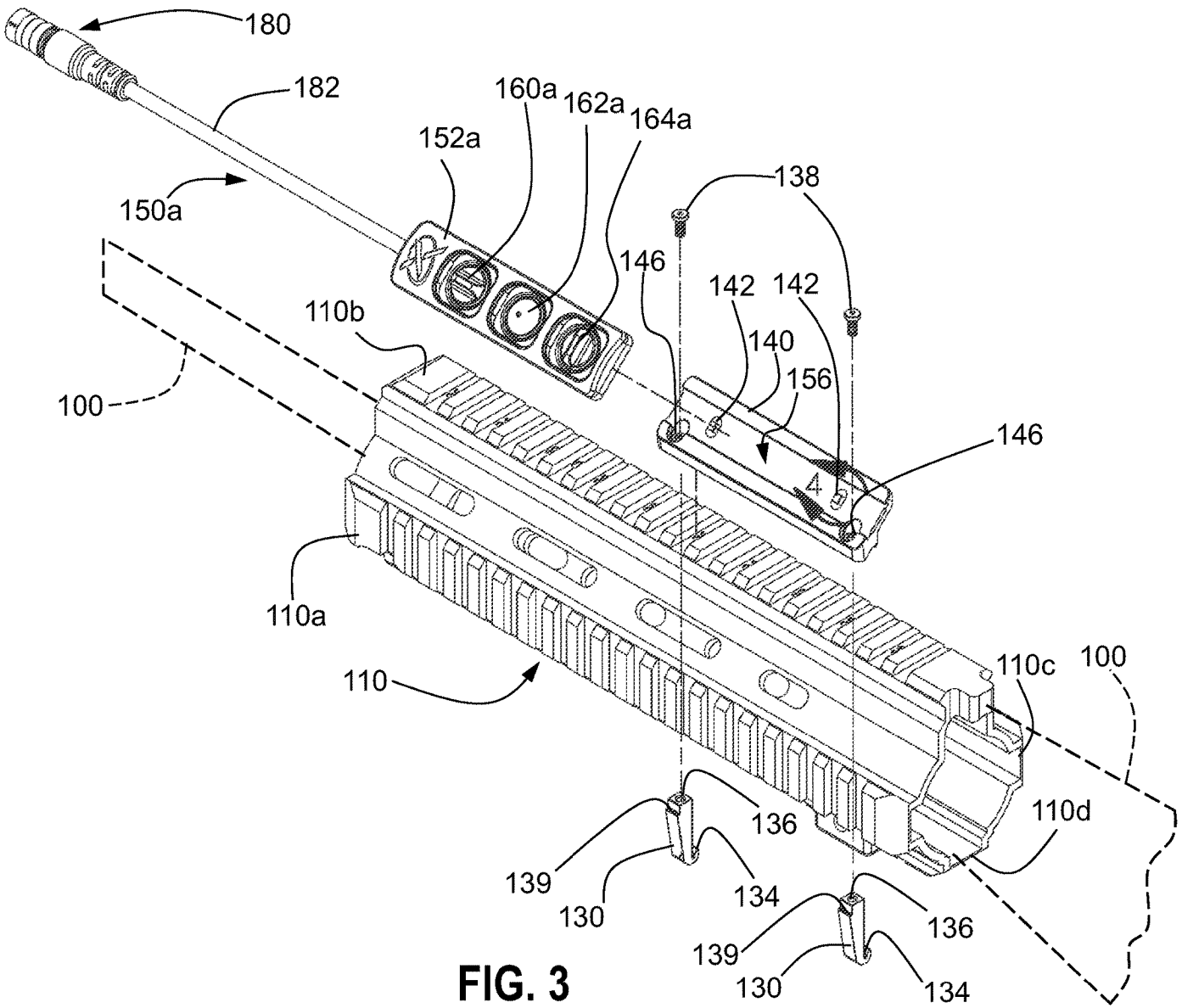
FIG. 3 is a partially exploded view of the pressure pad control apparatus appearing in FIG. 1.
Figure 4:
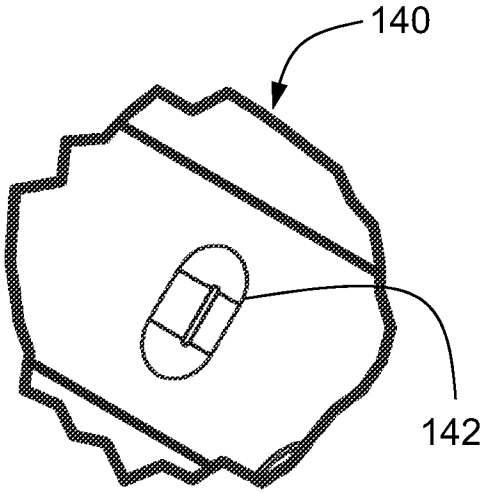
FIG. 4 is an enlarged view of the region 4 appearing in FIG. 3.
Figure 5:
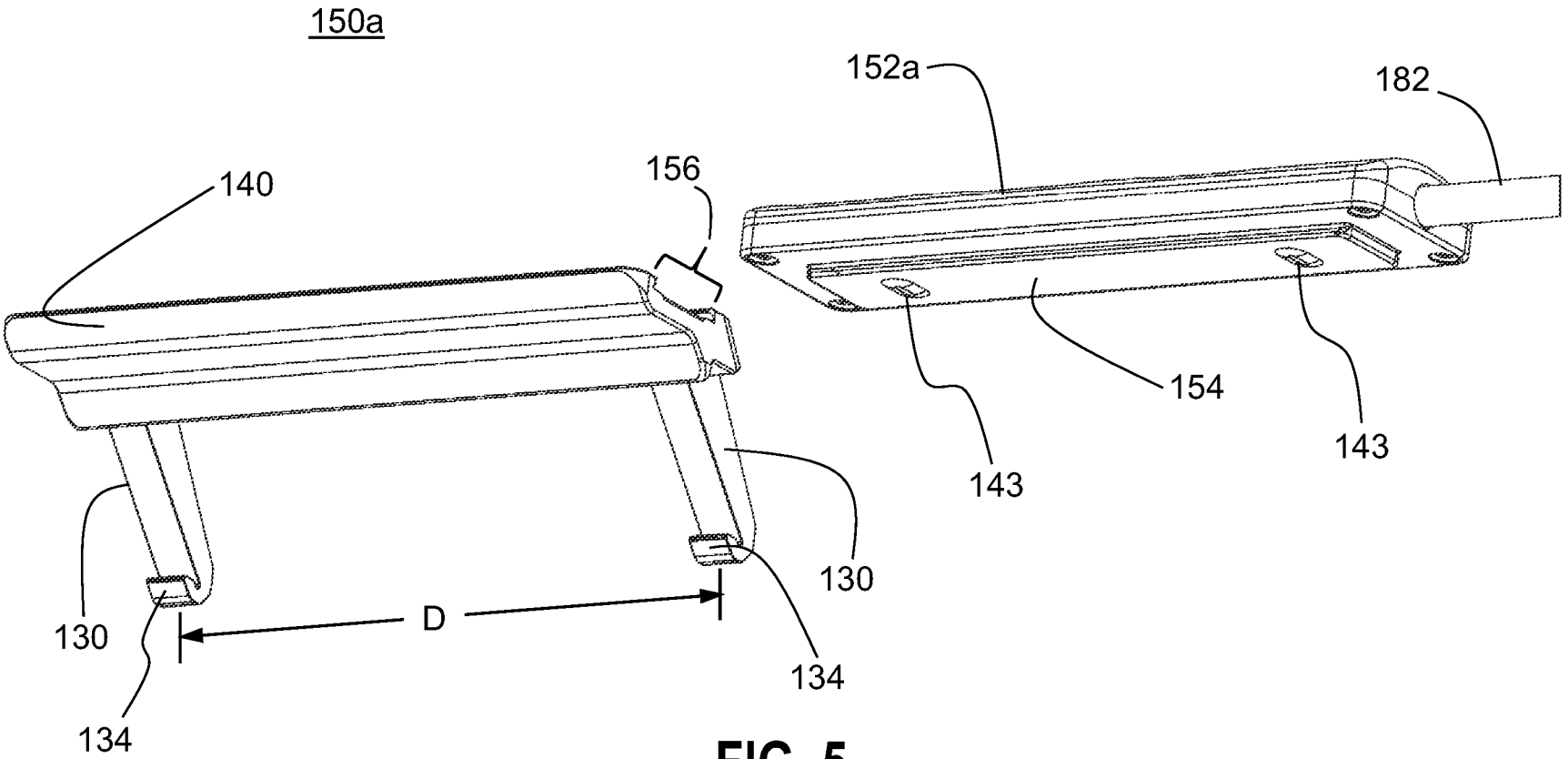
FIG. 5 is an enlarged assembly view of the interface rail portion of the pressure pad control apparatus appearing in FIG. 1, taken generally from the side and bottom.
Figure 6:
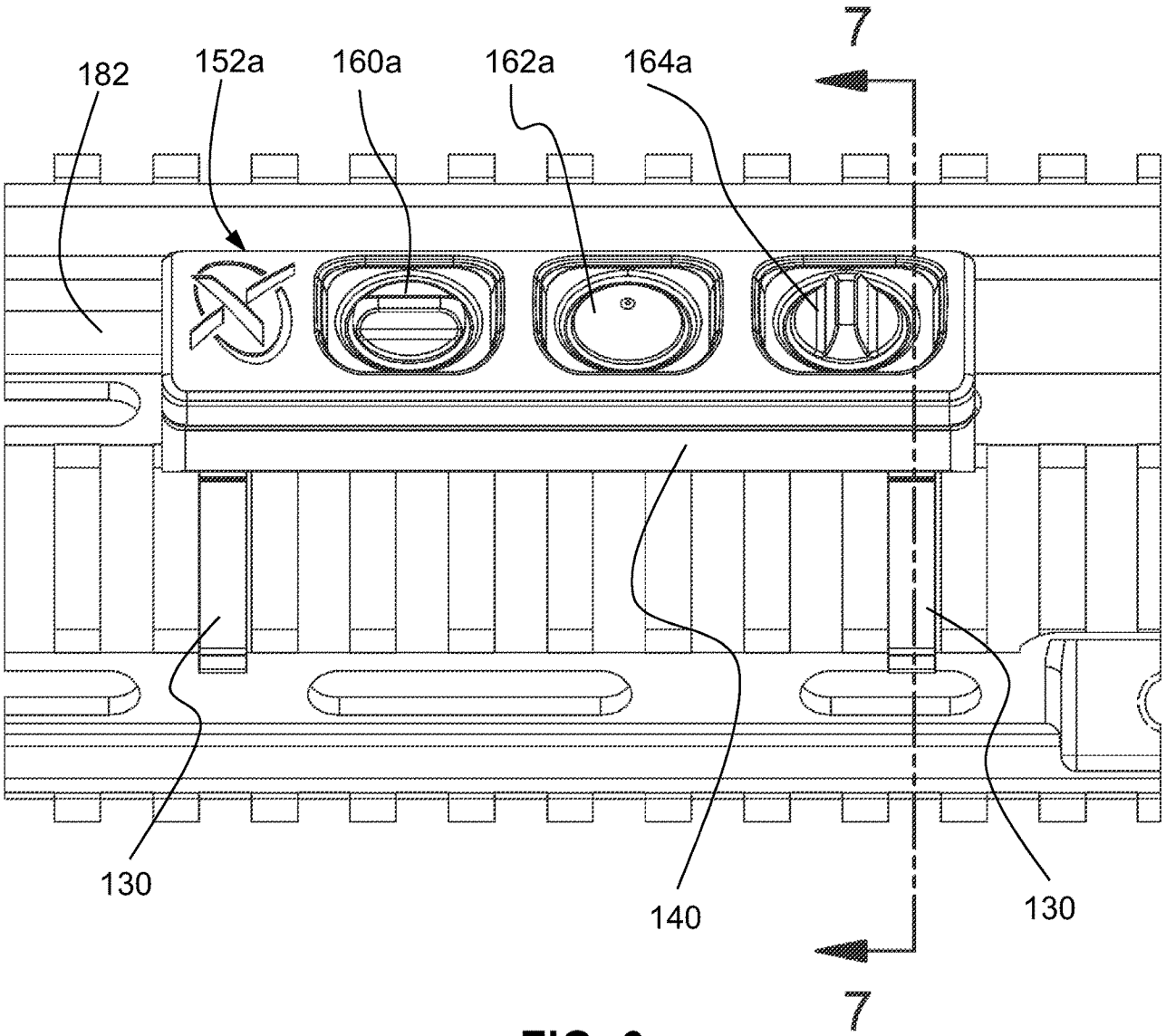
FIG. 6 is a fragmentary side view of a weapon accessory rail having a pressure pad in accordance with FIG. 1 mounted thereto.
Figure 7:
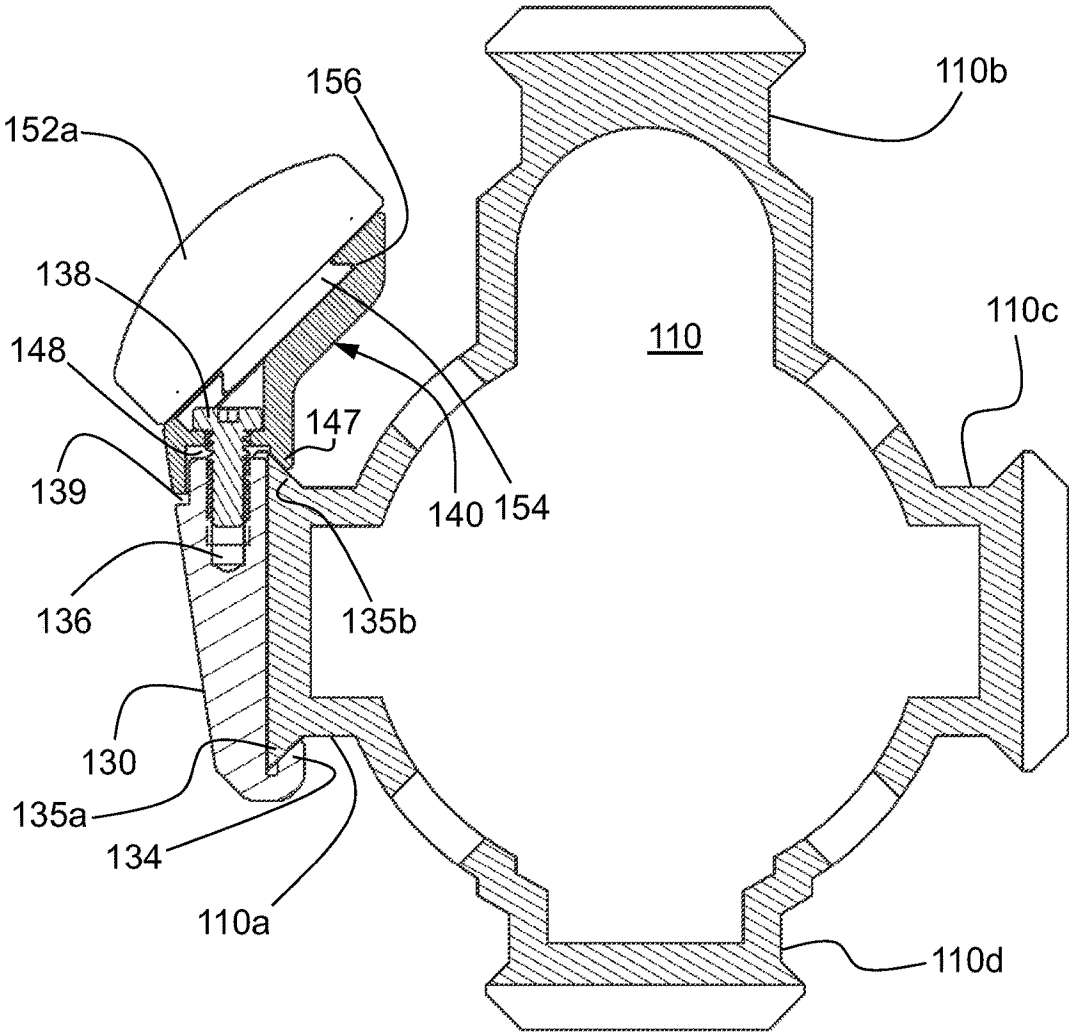
FIG. 7 is cross sectional view of the weapon accessory rail and pressure pad taken along the lines 7-7 appearing in FIG. 6.
Figure 8:
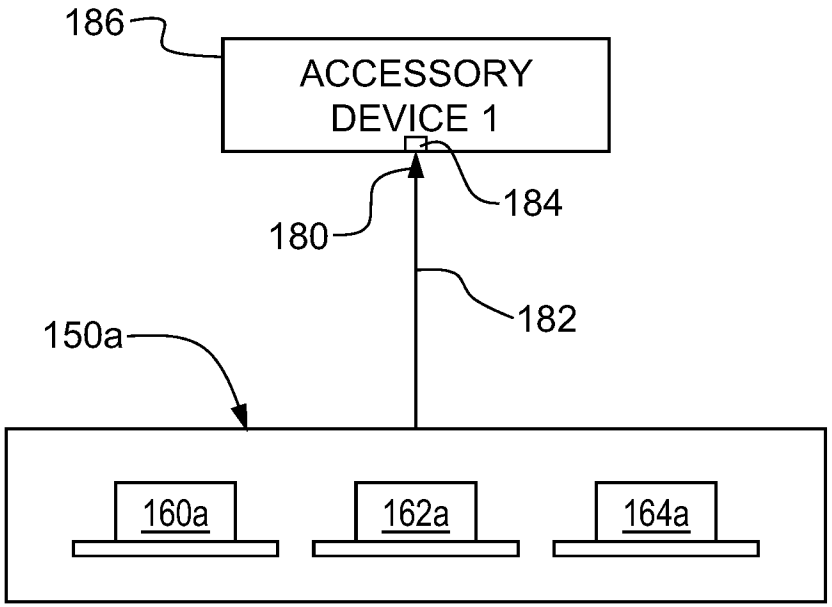
FIG. 8 is a schematic diagram of the pressure pad control apparatus embodiment appearing in FIG. 1.

With respect to the drawing figures, like or similar reference numerals are used to describe like or analogous items (e.g., the apparatus 150*a* in FIGS. 1 and 3 corresponds to the apparatus 150*b* in FIG. 2, and so forth). The description in reference to any given reference numeral herein is equally applicable to that reference numeral in the other views or embodiments, or any analogous reference numerals in the other views or embodiments, unless specifically stated otherwise.

Referring now to the drawings, FIGS. 1 and 3-8 depict a pressure pad control apparatus 150*a*. The apparatus 150*a* is mounted to an accessory rail interface assembly 110, e.g., a handguard rail, associated with a weapon 100. The weapon 100 may be a weapon such as a military or tactical rifle having a Picatinny rail interface 110 (e.g., as specified in MIL-STD-1913, STANAG 2324, or the like) having a beveled T-shaped cross-sectional shape having a plurality of transverse mounting projections 114 extending perpendicular to the longitudinal axis of the rail and separated by a plurality of transverse grooves 112 spaced along the longitudinal axis of the rail, as would be understood by persons skilled in the art. Although the present embodiment is illustrated as being connected to a left side rail 110*a* of a quad rail interface, it will be recognized that the present invention may be positioned along any rail, e.g., left, top, right, and bottom rails 110*a*-110*d*, respectively of a quad rail interface. For example, the apparatus 150*a* could be attached to the right side rail 110*c* for ambidextrous use. Additionally or alternatively, the present invention may be adapted for use with all manner of weapons or firearms, including without limitation, rifles, handguns, machine guns, mortars, grenade launchers, etc., and all manner of weapon accessory mount rail interfaces or mounting systems.

The pressure pad control assembly 150*a* includes an upper pressure pad housing portion 152*a* and a pressure pad interface rail 140. In certain embodiments, the pressure pad control assembly 150*a* is configured for low-profile attachment to the rail interface 110 in an orientation that is substantially parallel to the rail interface 110, although it will be recognized that embodiments configured for attachment of the assembly perpendicular or at any other angle relative to the long axis of the rail interface is also contemplated.

The pressure pad control assembly 150*a* includes a sliding type interface between the pressure pad housing portion 152*a* and pressure pad interface rail 140 comprising an axially extending mounting member 154 disposed on the bottom surface of the upper pressure pad portion 152*a* which engages a complementary axially-extending receptacle 156, such that the pressure pad portion 152*a* can be detachably and slidably mounted to the pressure pad interface rail 140. In certain embodiments, the axially-extending mounting member 154 and the axially-extending receptacle 156 have a trapezoidal (e.g., dovetail) cross-sectional shape. Alternative configurations for the mounting member 154 and receptacle 156 include T-shaped cross-sectional configurations, or mounting members that have parallel, axially-extending tongues or slide rails that slidably engage complementary grooves or channels in the pressure pad interface rail 140. In alternative embodiments, the sliding interface members may be reversed such that the mounting member 154 is disposed on the pressure pad interface rail 140 and the receptacle 156 is disposed on the exterior housing of the upper pressure pad portion 152*a*.

In embodiments, the pressure pad portion 152*a* is slidably mounted on the pressure pad interface rail 140 from either end of the pressure pad interface rail 140 and in either orientation (i.e., with the cable 182 extending in either direction with respect to the long axis of the weapon).

In embodiments, the pressure pad assembly 150*a* provides a detent mechanism which resists movement of the pressure pad portion 152*a* out of the engaged or secured position relative to the pressure pad interface rail 140 when the detent mechanism is engaged, while also providing relatively low friction once the detent mechanism is disengaged, e.g., when sliding the pressure pad portion 152*a* onto and off of the pressure pad interface rail 140.

In embodiments, detention features are provided to secure the pressure pad portion 152*a* to the pressure pad interface rail 140. In embodiments, the interfacing surface of the mounting receptacle 156 includes one or more detent bumps 142 which engage one or more complementary detent recesses 143 aligned and facing the interface surface of the mounting member 154 of the sliding the pressure pad portion 152*a*. When the upper pressure pad portion 152*a* is slidably received onto the pressure pad interface rail 140, the corresponding detent members 142, 143, are configured to engage with each other. The detent bumps 142 are resiliently biased into engagement with the detent recesses 143 to secure the pressure pad portion 152*a* to the pressure pad interface rail 140 at the appropriate position and to prevent inadvertent movement of the upper pressure pad portion 152*a* by increasing the sliding forced needed to disengage the detent member 142 from the detent recess 143.

In alternative embodiments, the detent bumps 142 reside on the mounting member 154 and the detent recesses 143 reside on the interfacing surface of the mounting receptacle 156. In embodiments, the detent members 142, 143 are coinciding symmetrical detents that allow the upper pressure pad portion 152*a* to be secured in a first orientation, e.g., wherein the cable 182 extends toward a fore end of the weapon 100, or a second orientation wherein the upper pressure pad portion 152*a* is rotated 180 degrees, e.g., wherein the cable 182 extends toward the rear end of the weapon 100. In this manner, the cable 182 can alternatively be configured to mount facing forward or backward to accommodate a desired position of an attached accessory device (e.g., a laser and/or flashlight) on the weapon accessory rail 110.

The pressure pad interface rail 140 is removably attached to the accessory rail interface 110 (e.g., the left rail 110*a* in the illustrated embodiment) of the weapon 100. In embodiments, the pressure pad assembly 150*a* includes one or more, and preferably 2, hooked drawbars 130, each having a J-shaped hook portion 134 at one end which is configured to engage an edge 135*a* of the accessory rail interface assembly 110*a* in a selected one of the transverse recoil grooves 112. The drawbars 130 preferably have a width which is approximately equal to the width of the slots 112.

Each hooked drawbar 130 also includes a threaded aperture 136 disposed opposite the hook 134 for receiving a corresponding threaded fastener 138. The pressure pad interface rail 140 includes a channel or groove 148 extending laterally along the length of the pressure pad interface rail 140. The groove 148 has an inclined or beveled inner surface 147 engaging an edge 135*b* of the rail interface assembly 110*a* within the selected recoil groove 112 opposite to the edge 135*a*. In embodiments, the groove 148 is also configured to receive an upper portion 139 of the drawbar 130.

The pressure pad interface rail 140 includes clearance openings 146 aligned with the threaded apertures 136 of the drawbars 130. The clearance openings 146 are axially spaced apart a distance D. The distance D is selected to be a multiple of the spacing increment between adjacent slots 112 to allow both of the apertures 146 to be aligned with a slot 112 on the rail 110. The threaded fasteners 138 pass through the clearance openings 146 and threadably engage the threaded openings 136 such that when the threaded fasteners 138 are tightened with respect to the threaded openings 136, the inclined surfaces 134 of the hooks 130 and the surfaces 147 on the assembly 152*a*, and the inclined surfaces 135*a* and 135*b* on the rail 110*a*, a clamping force is generated between the surfaces 147, 134 to secure the pressure pad interface rail 140 to the accessory rail interface 110*a*. In embodiments, the channel 148 on the pressure pad interface rail 140 and the hook portion 134 of the drawbar 130 effectively form a clamping, e.g., dovetail, mounting bracket.

In certain embodiments, the channel 148 and the receptacle 156 are configured to position the receptacle 156 at an angle relative to the accessory rail interface 110, such that the receptacle 156 is angled inward, toward a centerline of the rail interface 110. The inward angle of the receptacle 156 in the pressure pad interface rail 140, in turn, causes the upper pressure pad portion 152*a* to likewise be angled inward when the pressure pad assembly 150*a* attached to the accessory rail interface 110, to thereby allow the unit 150*a* to maintain a low profile. In addition, by positioning the pressure pad interface rail 140 at the end of the drawbar hook 130, the upper pressure pad portion 152*a* is not positioned directly over the rail 110*a*, but rather, is positioned in-between adjacent quadrant rails, e.g., 110*a* and 110*b*, which are of the type commonly found on rifle handguard rail interface assemblies, thereby preventing loss of the weapon grip when using the pressure pad assembly 150*a* to activate a device.

The pressure pad portion 152*a* further includes one or more user-depressible control elements or actuators (e.g., control buttons 160*a*, 162*a*, and 164*a* in the embodiment shown) for actuating a weapon-mounted accessory device 186. In the illustrated embodiment, the pressure pad portion 152*a* includes the three control buttons 160*a*, 162*a*, and 164*a*, each having a distinctive shape such that the user may easily distinguish between each button by touch. In the illustrated embodiment, the button 160*a* includes a raised ridge feature extending in an axial direction. The button 164*a* includes a raised ridge feature extending in a transverse direction. The button 162*a* has a smooth dome shape. By providing each of the buttons 160*a*, 162*a*, and 164*a* with a distinctive three-dimensional shape, the user can identify each button by touch without the need to look at the control pad. In some embodiments, the 3 control buttons 160*a*, 162*a*, and 164*a* are equally spaced to eliminate interference while wearing gloves.

The actuators 160*a*, 162*a*, and 164*a* are coupled to a first accessory device interface or connector 180 via a first cable 182. The first interface 180 engages a complementary interface or connector 184 on a first associated accessory device 186. In preferred embodiments, the first accessory device 186 is selected from a laser device and a flashlight. Exemplary laser devices include laser aiming or pointing devices (e.g., visible and infrared laser aiming or pointing devices) and target illumination devices (e.g., visible and infrared illuminators). Exemplary flashlights include LED flashlights and laser flashlights.

In certain embodiments, one or more of the control buttons 160*a*, 162*a*, and 164*a* may be configured to actuate the first accessory device 186. In certain embodiments, the control buttons 160*a*, 162*a*, and 164*a* may be used to select functions or modes or otherwise control operation of the first accessory device 186, e.g., through different functions assigned to each distinctive button, button presses of various lengths of time, e.g., quick press, medium press, long press, etc., button press sequences, e.g., single press, double press, triple press, etc., or combinations thereof.

In certain embodiments, one or more of the control buttons 160*a*, 162*a*, and 164*a* may be configured to actuate or otherwise control operation of an attached flashlight, e.g., by accessing functions such as brightness, strobe, SOS, or other modes, etc., e.g., through different functions assigned to each distinctive button or by the number of presses, hold time of a button press, and/or button press sequence.

In certain embodiments, one or more of the control buttons 160*a*, 162*a*, and 164*a* may be configured to actuate or otherwise control operation of an attached laser device, e.g., by accessing functions such as laser selection, laser intensity, or other modes, such as laser momentary on switch, laser on-off toggle switch, e.g., through different functions assigned to each distinctive button or by the number of presses, hold time of a button press, and/or button press sequence.

Figure 9:
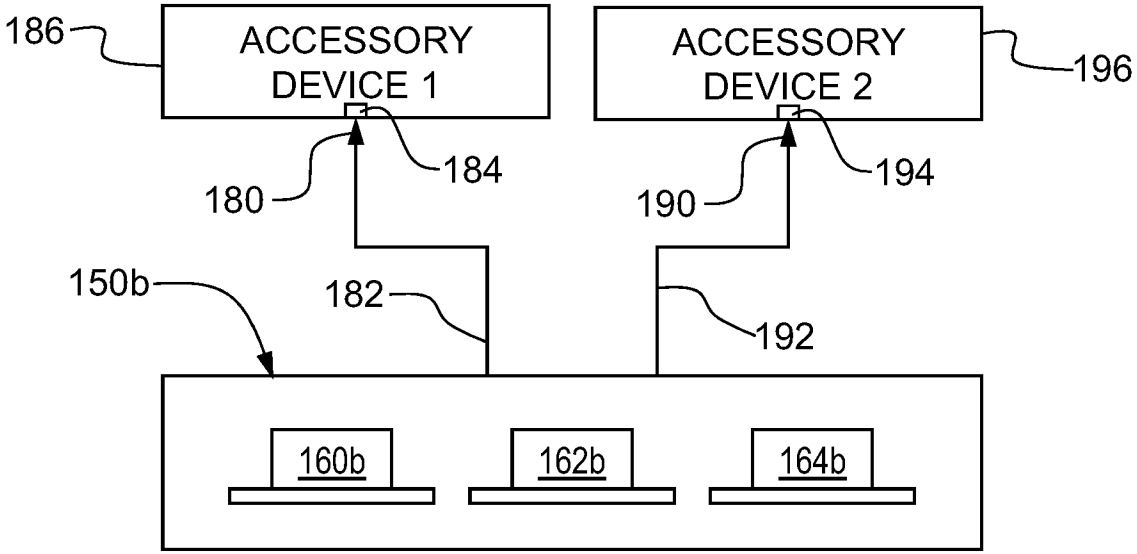
FIG. 9 is a schematic diagram of the pressure pad control apparatus embodiment appearing in FIG. 2.

Referring now to FIGS. 2 and 9, there is shown a second embodiment pressure pad control apparatus 150*b* which is as described above by way of reference to the pressure pad control apparatus 150*a*, the above description being equally applicable to the apparatus 150*b*. The pressure pad control apparatus 150*b* differs from the pressure pad control apparatus 150*a* only in that the upper pressure pad portion 152*b* additionally includes a second accessory cable 192 electrically coupled to the actuators 160*b*, 162*b*, and 164*b*. The cable 192 includes a second accessory device interface or connector 190. The second connector 190 is configured to engage a complementary interface 194 on a second associated weapon-mounted accessory device 196.

In preferred embodiments, the first and second accessory devices 186, 196 are selected from laser devices, such as a laser aiming or pointing device, aiming device, target illumination device, or flashlights. In preferred embodiments, the first accessory device 186 is a laser device, such as a laser aiming or pointing device, aiming device, or target illumination device. In certain embodiments, the second accessory device 196 is a flashlight.

In the illustrated embodiment, the cables 182, 192 are shown mounted facing forward. In embodiments, the cables 182, 192 can alternatively be configured to mount facing forward or backward to accommodate desired laser and/or flashlight position on the weapon accessory rail 110.

In certain embodiments, one or more of the control buttons 160*b*, 162*b*, and 164*b* may be configured to actuate either or both of the first and second accessory devices 186, 196. In certain embodiments, the control buttons 160*b*, 162*b*, and 164*b* may be used to select functions or modes or otherwise control operation of either or both of the first and second accessory devices 186, 196, e.g., through different functions assigned to each distinctive button, button presses of various lengths of time, e.g., quick press, medium press, long press, etc., button press sequences, e.g., single press, double press, triple press, etc., or combinations thereof.

In certain embodiments, one or more of the control buttons 160*b*, 162*b*, and 164*b* may be configured to actuate or otherwise control operation of an attached flashlight, e.g., by accessing functions such as brightness, strobe, SOS, or other modes, etc., e.g., through different functions assigned to each distinctive button or by the number of presses, hold time of a button press, and/or a button press sequence.

In certain embodiments, one or more of the control buttons 160*b*, 162*b*, and 164*b* may be configured to actuate or otherwise control operation of an attached laser device, e.g., by accessing functions such as laser selection, laser intensity, or other modes, such as laser momentary on switch, laser on-off toggle switch, e.g., through different functions assigned to each distinctive button or by the number of presses, hold time of a button press, and/or a button press sequence.

The description above should not be construed as limiting the scope of the invention, but as merely providing illustrations to some of the presently preferred embodiments of this invention. In light of the above description and examples, various other modifications and variations will now become apparent to those skilled in the art without departing from the spirit and scope of the present invention as defined by the appended claims. Accordingly, the scope of the invention should be determined solely by the appended claims and their legal equivalents.

What is claimed is:

1. An apparatus for controlling operation of a weapon-mounted accessory device, comprising:

a pressure pad interface rail comprising a first elongate attachment channel configured to receive a first transverse edge of a weapon accessory rail, the pressure pad interface rail further comprising a second elongate attachment channel extending parallel to the first elongate attachment channel;

a pressure pad housing having an elongate mounting member disposed on a first surface thereof and one or more user-depressible control elements disposed on a second surface thereof, the elongate mounting member configured to be slidably and detachably received within the first elongate attachment channel;

a first drawbar having a proximal end received within the first elongate attachment channel and a distal end forming a first hook, the first hook configured to engage a second transverse edge of the weapon accessory rail opposite the first transverse edge;

a first threaded bore formed in the proximal end of the first drawbar;

a first threaded fastener disposed within the second elongate attachment channel and passing through a first clearance opening into the first elongate attachment channel and threadably engaging the first threaded bore to detachably secure the first drawbar to the pressure pad interface rail, wherein tightening the first threaded fastener is configured to exert a clamping force between the first elongate attachment channel and the first hook and wherein loosening the first threaded fastener is configured to release the clamping force between the first elongate attachment channel and the first hook; and a first electrical connector in electrical communication with the one or more user-depressible control elements and configured to operably couple the user-depressible control elements to the weapon-mounted accessory device.

2. The apparatus of claim 1, wherein each of the second elongate attachment channel and elongate mounting member has a trapezoidal cross sectional shape.

3. The apparatus of claim 1, wherein the one or more user-depressible control elements comprises a keypad having a plurality of user-depressible switches.

4. The apparatus of claim 3, wherein each of said user-depressible switches has a three-dimensional shape which is different than the other ones of the user-depressible switches.

5. The apparatus of claim 1, wherein the first elongate attachment channel is configured to couple with a Picatinny rail interface comprising a plurality of transverse mounting projections extending perpendicular along a longitudinal axis of the weapon accessory rail and separated by a plurality of transverse grooves spaced along the longitudinal axis of the weapon accessory rail.

6. The apparatus of claim 5, wherein the first drawbar is configured to be at least partially received within one of the transverse grooves.

7. The apparatus of claim 5, wherein the first drawbar has a width which is approximately equal to a width of the transverse grooves.

8. The apparatus of claim 1, further comprising:

a second drawbar axially spaced apart from the first drawbar, the second drawbar having a proximal end received within the first elongate attachment channel and a distal end forming a second hook, the second hook configured to engage the second transverse edge of the weapon accessory rail;

a second threaded bore formed in the proximal end of the second drawbar;

a second threaded fastener disposed within the second elongate attachment channel and passing through a second clearance opening into the first elongate attachment channel and threadably engaging the second threaded bore to detachably secure the second drawbar to the pressure pad interface rail, wherein tightening the second threaded fastener is configured to exert a clamping force between the first elongate attachment channel and the second hook and wherein loosening the threaded fastener is configured to release the clamping force between the first elongate attachment channel and the second hook.

9. The apparatus of claim 8, wherein each of the first and second drawbars is configured to be at least partially received within an aligned one of the transverse grooves.

10. The apparatus of claim 1, further comprising a second drawbar having a proximal end configured to detachably engage the first elongate attachment channel of the pressure pad interface rail and a distal end forming a hook, the hook configured to engage the second transverse edge of the weapon accessory rail, wherein the second drawbar is axially spaced apart from the first drawbar.

11. The apparatus of claim 1, wherein the pressure pad interface rail and the hook each have a beveled surface configured to engage the weapon accessory rail.

12. The apparatus of claim 1, further comprising a first detention feature disposed on the elongate mounting member and a second detention feature complementary with the first detention feature disposed within the second elongate attachment channel, the first and second detention features cooperating to secure the pressure pad housing in a fixed position on the pressure pad interface rail when the first and second detention features are aligned and engaging and to allow sliding movement of the pressure pad housing with respect to the pressure pad interface rail when the first and second detention features are not aligned and engaging.

13. The apparatus of claim 12, wherein the first and second detention features are symmetrically positioned to secure the pressure pad housing in a fixed position on the pressure pad interface rail when the pressure pad housing is disposed in a first orientation with respect to the pressure pad interface rail and in a second orientation with respect to the pressure pad interface rail, the second orientation being one hundred eighty degrees from the first orientation.

14. The apparatus of claim 12, further comprising a third detention feature disposed on the elongate mounting member and a fourth detention feature complementary with the third detention feature disposed within the elongate channel, the third and fourth detention features cooperating to secure the pressure pad housing in a fixed position on the pressure pad interface rail when the third and fourth detention features are aligned and engaging and to allow sliding movement of the pressure pad housing with respect to the pressure pad interface rail when the first and second detention features are not aligned and engaging.

15. The apparatus of claim 1, further comprising a first cable electrically coupling the first electrical connector with the one or more user-depressible control elements, wherein the first cable extends from the housing in a direction parallel to a longitudinal axis of the weapon accessory rail.

16. The apparatus of claim 15, further comprising a second cable electrically coupling a second electrical connector with the one or more user-depressible control elements, wherein the second cable extends from the housing in a direction parallel to the longitudinal axis of the weapon accessory rail.

17. The apparatus of claim 16, wherein each of the first and second electrical connectors is configured to electrically couple the one or more user-depressible control elements to an accessory device selected from the group consisting of laser accessory devices and flashlights.

18. The apparatus of claim 1, wherein the pressure pad interface rail is structured and operable to position the pressure pad housing in an offset position in relation to the weapon accessory rail when the a pressure pad interface rail is attached to the weapon accessory rail and the pressure pad housing is coupled to the pressure pad interface rail.

* * * * *